United States Patent [19]

Seewald

[11] Patent Number: 4,718,196

[45] Date of Patent: Jan. 12, 1988

[54] GRINDING MACHINE WORKHEAD FITTED WITH A DRESSING TOOL

[75] Inventor: Heinrich Seewald, Huttwilen, Switzerland

[73] Assignee: AB UVA, Bromma, Sweden

[21] Appl. No.: 902,371

[22] PCT Filed: Dec. 18, 1985

[86] PCT No.: PCT/SE85/00530

§ 371 Date: Sep. 25, 1986

§ 102(e) Date: Sep. 25, 1986

[87] PCT Pub. No.: WO86/03706

PCT Pub. Date: Jul. 3, 1986

[30] Foreign Application Priority Data

Dec. 19, 1984 [SE] Sweden ..... 8406490

[51] Int. Cl.[4] ..... B24B 53/04

[52] U.S. Cl. ..... 51/5 D; 51/165.93; 51/236; 125/11 CD

[58] Field of Search ..... 51/5 D, 236 R, 165.93; 125/11 R, 11 CD

[56] References Cited

U.S. PATENT DOCUMENTS

| | | | |
|---|---|---|---|
| 1,662,242 | 3/1928 | Drake | 125/11 R |
| 2,178,842 | 11/1939 | Paine | 125/11 B |
| 3,924,355 | 12/1975 | Tatsumi et al. | 51/3 |
| 4,112,624 | 9/1978 | Uhtenwoldt et al. | 125/11 CD |
| 4,259,940 | 4/1981 | Asano et al. | 125/11 CD |
| 4,265,054 | 5/1981 | Ito | 51/3 |
| 4,286,413 | 9/1981 | Axelsson et al. | 51/3 |

*Primary Examiner*—Harold D. Whitehead

*Attorney, Agent, or Firm*—Sughrue, Mion, Zinn, Macpeak and Seas

[57] ABSTRACT

For dressing a rotating grinding wheel which grinds a workpiece held in a chuck, there is mounted on an extension of the chuck, an annular dressing tool having an inner lining of diamond, for example. The dressing annular is accurately centered relative to the workpiece. The grinding wheel is moved through the short distance between the workpiece and the dressing annulus.

4 Claims, 3 Drawing Figures

GRINDING MACHINE WORKHEAD FITTED WITH A DRESSING TOOL

FIELD OF INVENTION

The present invention relates to a grinding machine tail-stock fitted with a dressing tool.

BACKGROUND PRIOR ART

It is necessary to dress, or to true abrasive grinding tools of the aforesaid kind from time to time, in order to restore the tool to its original geometry, which shall be rotationally symmetrical with a given generatrice, and to remove all abrasive grains and to expose fresh grains which present sharp cutting edges.

To this end a grinding machine is normally equipped with a dressing tool which incorporates an extremely hard material, often diamond, and which may have a varying form or geometry. In many instances, the dressing tool is in the form of a rotatable diamond cylinder or disc. When the abrasive grinding tool is to be dressed, or trued, the tool is moved from its grinding location to a dressing location, where it is dressed. The tool is then moved back to its grinding location, and grinding is continued.

A rotatable dressing tool of this kind is normally mounted on a separate journal bearing, which of necessity must be robust and reliable in order not to lose accuracy when dressing the abrasive grinding tool. As before-mentioned, the dressing tool is normally in the form of a cylinder, wheel or disc having an outer or peripheral diamond lining, or a coating of some other highly wear-resistant material.

The time taken to move the grinding tool from its grinding location to the aforesaid dressing location is of relatively long duration and prolongs the time taken to complete a grinding cycle, besides constituting an interruption in the grinding cycle. In addition hereto, the dressing-tool bearing, upon which the aforesaid high demands are placed, constitutes a cost-increasing complication which markedly increases the total costs of the grinding machine.

The conventional method of mounting a dressing tool also gives rise to a further problem which is not readily resolved, namely that a temperature difference often prevails between the location at which the grinding tool engages the workpiece and the location at which it engages the dressing tool. The machine components supporting the grinding tool, the workpiece and the dressing tool are subjected to changes in linear measurement as a result of these temperature differentials, which may have a comparatively serious effect on grinding accuracy. It will be noted that grinding work of the kind envisaged here often demands a measuring accuracy of a fraction of a micron.

In U.S. Pat. No. 4,259,940 (Asano et al) there is described a grinding machine tail-stock fitted with a dressing tool, said grinding machine comprising (a) a holding device, such as a chuck for rotatably supporting a workpiece;

(b) a tool slide for rotatably supporting a grinding tool;

(c) means for effecting axial relative displacement of the tool slide and/or a chuck in a manner to move the grinding tool into and out of a workpiece engagement location, and to feed the grinding tool in an axial direction;

(d) means for effecting transverse relative movement of the tool slide and/or the chuck for engagement of the grinding tool with the workpiece, and for transverse feed relative thereto;

(e) a dressing tool mounted in connection with the holding device for co-rotation therewith.

The grinding wheel of this grinding machine has a rather big diameter. A truing wheel and a dressing roll are coaxially fixed on a work support shaft of a work head in juxtaposed relation with each other. A wheel feed mechanism is used to infeed a grinding wheel against the truing wheel so as to establish between the dressing wheel and the grinding wheel a gap of predetermined distance toward which free abrasive grains acting as a dressing agent are supplied. This arrangement has some of the above-mentioned drawbacks.

U.S. Pat. No. 4,112,624 (Uhtenwoldt et al) describes a shoe-type grinding machine having a work head including an annular platen which rotates and engages one end of the workpiece and includes shoes which engage the outer surface of the workpiece. A dressing wheel in the form of an annulus is mounted on the workpiece clamp. This arrangement belongs to a different type of grinding machines. Due to the fact that the axis of the annular platen is neither coaxial with the axis of the workpiece nor with that of the grinding tool the result of the grinding operation will be negatively affected. Therefore, such a machine cannot be used when there are high requirements on the grinding operation.

OBJECT OF THE INVENTION

An object of the present invention is to provide a grinding machine tail-stock fitted with a dressing tool with which the afore-mentioned disadvantages and drawbacks are avoided, thereby enabling a grinding operation to be carried out with greater accuracy and in a shorter length of time than with prior art arrangements.

DISCLOSURE OF THE INVENTION

The grinding machine tail-stock according to the invention is fitted with a dressing tool and is of the kind stated above. It is mainly characterized in that the holding device, e.g. the chuck, has an outwardly projecting auxiliary device which carries at an axial distance externally of the workpiece concentrical with the geometric axis thereof an annular dressing tool having an inner diameter which is larger than the diameter of the round surface of the workpiece, and includes an annular holder-part having an inner dressing lining of, e.g. diamond material, such that the grinding tool passes through the dressing tool when brought into engagement with the workpiece.

The axis of the dressing tool is accordingly concentric with the axis of the workpiece and the dressing tool takes the same level as the grinding tool.

One important advantage afforded by the invention is that the distance from the grinding location to the dressing location is extremely short, therewith providing a considerable saving in time, especially in such cases when high demands are placed on the accuracy of the grinding operation and therewith necessitating relatively frequent dressing of the grinding tool.

The short distance between grinding location and dressing location also means that variations in temperature will be small or non-existent, therewith in many instances increasing the accuracy to which work can be carried out.

Because the dressing tool has the same geometric rotational axis as the spindle carrying the chuck, the tool is also highly accurate and is rigidly mounted with the aid of journalling components originally fitted to the machine, i.e. without incurring additional journalling costs solely in respect of the dressing tool.

It will also be observed that these advantages afforded by the invention are obtained with the use of extremely simple and robust machine components and tools, therewith rendering the provision of high-cost auxiliary arrangements and devices unnecessary.

In practice, the dressing tool is provided with a cylindrical and a conical surface for dressing, or truing, corresponding surfaces on one or more grinding tools intended for working mutually different surfaces of a workpiece.

For example, in the case of workpieces which present a cylindrical interior surface and a conical seat, the cylindrical surface can be worked first with a cylindrical grinding tool, which is dressed with the aid of a cylindrical part of the dressing tool, while the conical seat, or bottom, is worked with a corresponding conical grinding tool, which is dressed with the aid of a conical dressing surface on the dressing tool.

The auxiliary device may present means for indicating the relative concentricity of the dressing tool and the workpiece, and for making adjustments in connection therewith.

Further details of the invention will appear from the following description with reference to the attached drawings of some preferred embodiments thereof.

DESCRIPTION OF PREFERRED EMBODIMENTS

Figure 1:
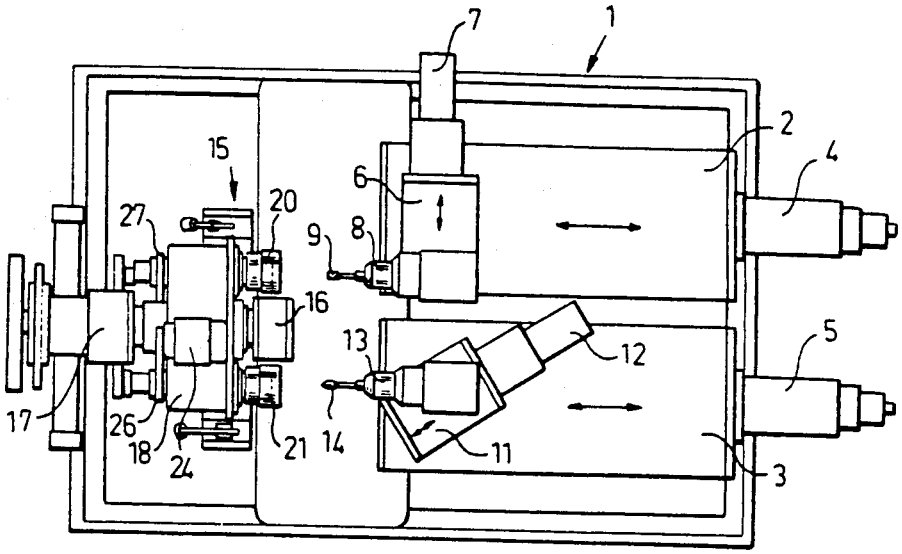
FIG. 1 is a plan view of a hole-grinding machine, or an internal, cylindrical grinding machine, having a double grinding function and adapted for carrying-out the method according to the invention.

FIG. 1 illustrates an internal, cylinder grinding machine having a double function, such as a hole-grinding function and a seat or bottom grinding function, for grinding mutually concentric internal and end surfaces of a blind hole or bore formed in a workpiece.

The grinding machine includes a worktable 1, having milled therein guides (not shown) along which two table slides 2 and 3 can be moved with the aid of ball-bearing screws (not shown).

Each ball-bearing screw is turned by means of a respective servomotor 4, 5. Arranged on the worktable 1 for transverse movement in relation to the table is a feed slide 6, which is also guided by a ball-bearing screw (not shown), this screw being turned by a d.c. motor 7. Mounted on the feed slide 6 is a grinding spindle 8, having fitted thereto a grinding wheel 9. The grinding spindle is driven by a high-frequency electric motor, or alternatively a pneumatic turbine. The grinding wheel 9 is intended for hole-grinding purposes and the table slide 2 is responsible for axial movement of the grinding wheel, whereas the feed slide 6 is responsible for movement of the grinding wheel in the radial infeed direction.

Arranged on the table slide 3 is an oscillation slide 11, which is moved across the slide by means of a servomotor 12. The slide 11 accommodates a grinding spindle 13 having a grinding wheel or disc 14 mounted thereon. The grinding-spindle motor is of the same kind as for the grinding spindle 8. The grinding wheel 14 of the illustrated embodiment is intended for grinding the bottom surface of a blind hole or bore.

Arranged opposite the grinding spindles 8 and 13 is a stepping unit 15, having a stepping tail-stock 18 which is rotatable about a centre axis. The tail-stock 18 has journalled therein two chuck spindles 20, 21 whose respective geometric axes extend parallel with the rotary axis of the tail-stock and equidistant therefrom. Mounted on the forward ends of the chuck spindles 20 and 21, i.e. the ends facing the grinding spindles 8 and 13, are well-centered chucks 30, 31, which are intended to hold the workpieces to be ground. Each of the chuck spindles is driven by an individual drive-motor 24, via drive belts 26, 27.

In other respects, this general arrangement of the grinding spindles and stepping-stock is similar to that described in Swedish Patent Specification No. 7807876-3 (publication No. 417,485) from which a more detailed description of such grinding machines can be had.

Figure 2:
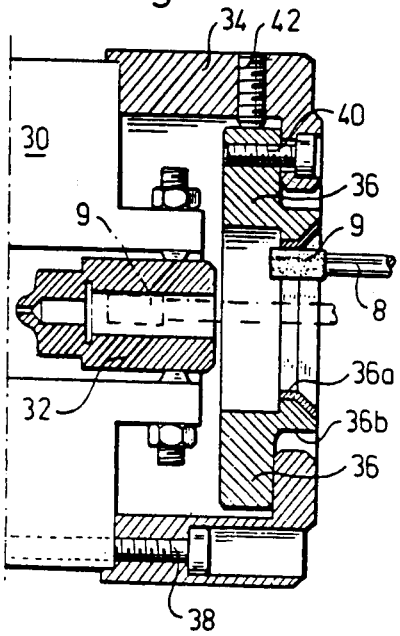
FIG. 2 is a cross-sectional view which illustrates in full lines the grinding wheel or disc of one grinding spindle in a dressing position.

Each chuck spindle 20, 21 carries a respective chuck 30, 31 for holding respective workpieces 32, 33, which in the illustrated embodiment are assumed to comprise ejection nozzles for diesel engines, on which hole and seat grinding operations are to be carried out. FIG. 2 illustrates in broken lines the grinding wheel or disc 9 located within the workpiece in order to effect a hole-grinding cycle, while FIG. 3 illustrates in broken lines the position of the grinding wheel or disc 14 when grinding a seat in the workpiece 33.

Each chuck 30, 31 has an extension 34 and 35, which carries a respective annular dressing, or truing, tool 36 and 37, these tools being arranged concentric with the geometric axis of their respective chuck spindle 20, 21. The annular dressing tools 36, 37 have each provided thereon a diamond lining **36*a*, 37*a***, or alternatively a lining of some other highly wear-resistant material, and present a cylindrical part and a conical, outwardly widened part.

In an alternative embodiment the dressing tools 36, 37 with their respective linings **36*a*, 37*a*** may have such varying geometry as to permit the dressing annulae to dress grinding tools of varying geometry and characteristics. For instance one tool may accomplish "rough-dressing" and the other one "fine-dressing". Alternatively, one tool may accomplish "dressing" and the other one "truing".

Figure 3:
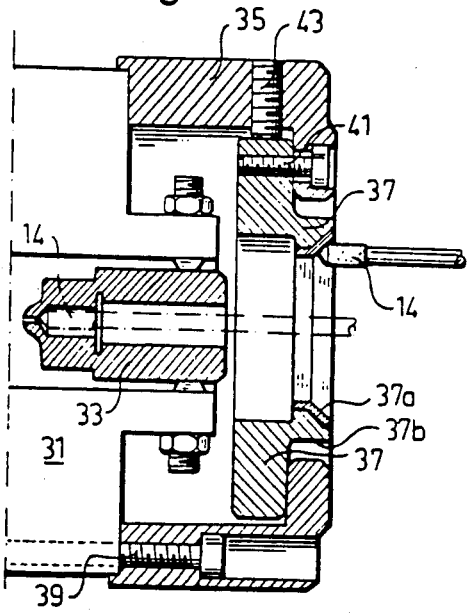
FIG. 3 is a view similar to FIG. 2 and illustrates dressing of the other grinding wheel or disc.

FIGS. 2 and 3 illustrate respectively the grinding wheel 9 in abutment with the cylindrical part of the diamond lining **36*a*, and the conical point of the grinding wheel 14** in abutment with the conical part of the lining.

As will be seen, the distance between the working and dressing positions of respective grinding wheels is extremely short, therewith providing the aforesaid advantages.

The chuck extensions 34, 35 are fastened to respective chucks 30, 31 by means of screws 38, 39, and the dressing tools 36, 37 are fastened to respective chuck extensions by screws 40, 41. Consequently, the arrangement is such as to enable precise adjustment of the concentricity of respective dressing tools. Setting screws for adjusting the setting of the concentricity of the tools are referenced 42 and 43, respectively, and are suitably provided in pairs, with an angular screw-spacing of 90° between each pair. Only a single screw 42, 43 of respective screw pairs is shown in FIGS. 2 and 3. A given peripheral surface on the dressing tool, e.g. the surface referenced **36*b* in FIG. 2 and 37*b* in FIG. 3, may serve as a reference surface for indicating possible deviations with respect to concentricity. To this end, these given surfaces 36*b*, 37*b*, may be arranged to co-operate with an indicating gauge (not shown) adapted to show any concentricity deviations, which can then be corrected with the aid of the screws 40, 42 and 41, 43**, respectively.

When grinding annular workpieces of comparatively large diameter, the aforedescribed arrangement can be reversed, if so desired. Thus, although not explicitly illustrated, the dressing tool, which in this case has smaller dimensions, is held in the chuck itself, while the annular workpiece for example is held in a chuck extension. It will be seen that corresponding advantages are afforded also in this case.

The invention also embraces the instance when the surface provided with the dressing lining has a generatrice of more or less complicated configuration, which enables the grinding wheel to be given the same generatrice through a linear approach between the dressing lining and the grinding wheel. This method is sometimes referred to as "contour dressing".

Subsequent to giving the grinding wheel the desired geometry by means of such a contour dressing operation, often in a single grinding cycle, a corresponding geometry is given to a workpiece. In this case, in the performance of a grinding operation the grinding wheel is normally fed-in at right angles to its axis direction and does not normally move axially, so-called oscillatory movement.

The dressing lining may be given a geometry which corresponds to the geometry of the grinding wheel or wheels to be dressed.

Further, the dressing tool may comprise just a ring with the lining **36*a* or 37*a*, respectively, having a certain thickness and being easily replaceably insertable into a holder comprising the parts 34, 36 or 35, 37 with appertaining screws. In this embodiment the lining 36*a*, 37*a*** has the same axial width as the ring proper.

It will be understood that although reference has been made in the aforegoing predominantly to a dressing tool, the invention applies equally as well to a truing tool, and that all mention hereinbefore or hereinafter to a dressing tool also includes a truing tool.

I claim:

1. A grinding machine workhead fitted with a dressing tool, said grinding machine comprising:

(a) a chuck (30; 31) for rotatably supporting a workpiece (32; 33);

(b) a tool slide (6; 11) for rotatably supporting a grinding tool (9; 14);

(c) means (2, 4; 3, 5) for effecting relative axial displacement between the tool slide and the chuck to move the grinding tool into and out of a workpiece engagement location, and to attendantly feed the grinding tool in an axial direction;

(d) means (6, 7; 11, 12) for effecting relative transverse movement between the tool slide and the chuck to engage the grinding tool with the workpiece, and for attendantly transversely feeding the grinding tool; and (e) a dressing tool (**36*a*, 37*a*) mounted in association with the chuck for co-rotation therewith; wherein (f) the chuck (30; 31) has an outwardly projecting auxiliary member (34; 35) which carries at an axial distance externally of the workpiece (32; 33) and concentric with the geometric axis thereof an annular dressing tool (36) (37) having an inner diameter larger than an outer diameter of the workpiece, said dressing tool including an annular holder having an inner dressing lining (36*a*, 37*a*) of diamond material or the like, such that the grinding tool (9, 14) passes through the dressing tool when brought into engagement with the workpiece, and the auxiliary member includes means (40, 42; 41, 43**) for adjusting the relative concentricity between the dressing tool and the workpiece.

2. A grinding machine workhead according to claim 1, wherein the dressing lining (**36*a*; 37*a***) has a cylindrical surface and a conical, outwardly widened surface.

3. A grinding machine workhead according to claims 1 or 2, comprising two tables slides (2; 3), each provided with a grinding spindle (8; 13) carrying a grinding wheel (9; 14), and a workhead assembly (15) having an indexing unit (18) which is rotatable about a centre axis and in which two chuck spindles (20, 21) are journalled, each having a respective chuck (30; 31) mounted on one end thereof, wherein each chuck (30, 31) has an extension (34; 35) which carries an annular dressing tool (36; 37) supported concentrically with the geometric axis of a respective chuck spindle (20; 21) and which is provided with an inner dressing lining (**36*a*; 37*a***) of predetermined geometry.

4. A grinding machine workhead according to claim 1, wherein the dressing tool comprises a cylindrical ring, and the lining has substantially the same axial width as the ring, the ring being replaceably supported in the auxiliary member.

* * * * *